United States Patent [19]

Pahnke

[11] Patent Number: 4,905,495

[45] Date of Patent: Mar. 6, 1990

[54] LONG FORGING MACHINE FOR THE FORGING OF ROUND OR SHARP-EDGED BARS

[75] Inventor: Hans-Joachim Pahnke, Dusseldorf, Fed. Rep. of Germany

[73] Assignee: Pahnke Engineering GmbH & Co. KG, Dusseldorf, Fed. Rep. of Germany

[21] Appl. No.: 289,021

[22] Filed: Dec. 23, 1988

[30] Foreign Application Priority Data

Jan. 7, 1988 [DE] Fed. Rep. of Germany ..... 3800220

[51] Int. Cl.[4] ..... B21J 9/16

[52] U.S. Cl. ..... 72/402; 72/447

[58] Field of Search ..... 72/402, 447, 446, 399, 72/76

[56] References Cited

U.S. PATENT DOCUMENTS 3,837,209 9/1974 Guse ..... 72/402

3,841,125 10/1974 Guse ..... 72/402

FOREIGN PATENT DOCUMENTS 2159461 7/1975 Fed. Rep. of Germany .

1302095 1/1973 United Kingdom ..... 72/402

OTHER PUBLICATIONS

SMS Sutton Inc.—The RUMX Radial Forging Machine, by Green, M. G. et al, SMS Hasenclever Division, Pittsburgh, PA.

*Primary Examiner*—Daniel C. Crane

*Attorney, Agent, or Firm*—Fleit, Jacobson, Cohn, Price, Holman & Stern

[57] ABSTRACT

To permit round and sharp-edged bars to be forged down to the smallest sizes on a long forging machine without the need for tool changes, swivelling steering levers which guide rams carrying tools, are provided with additional tools which may be actuated together with the tools at the ram ends when the steering levers are in a freely movable state and the rams are positively locked inside the steering levers. When the steering levers are locked to the machine frame and the rams are guided linearly, material preforged to rounds may be finish-forged to sharp-edged bars, in which case the pairs of oppositely positioned ram-end tools, will function as two free forging presses arranged on different vertical planes.

7 Claims, 2 Drawing Sheets

LONG FORGING MACHINE FOR THE FORGING OF ROUND OR SHARP-EDGED BARS

TECHNICAL FIELD

Background of the Invention

The invention relates to a long forging machine for the forging of round or sharp-edged bars, with four drive units radially arranged on a plane transverse to the forging axis, with synchronously driven rams which carry pairs of oppositely positioned tools, the rams being guided in straight guides by steering levers which may be selectively retained in place with respect to the machine frame or swivelled on the vertical plane together with the rams which are in their retained positions relative to the straight guides. The drive units are known both in the form of a synchronized mechanical drive and a hydraulic drive with working cylinders.

To clearly describe the background of the invention, the long forging machines generally in use will now be described.

Two types of long forging machines are strictly radial forging machines with linearly and radially guided rams or tools. Since the tools are driven synchronously on a common vertical plane, the tool width is determinant for the end position of the stroke at which the tools will collide. However, the width of the tool cannot be selected optionally small in order to permit a workpiece to be forged down to the smallest section in a single process due to the fact that a relatively small tool width would limit the reduction per forging stroke. Since the forging technique calls for a heavy reduction at the very beginning of a forging process, the tool is generally sized to permit the workpiece to be heavily reduced by turning and preforging the work piece round, down to a cross sectional size at which the tools collide. Consequently, one of the known machine types requires the tools to be changed to produce the final forging section. The other type, a strictly radial forging machine, permits the tools to be shifted equidirectionally and transverse to the forging axis, i.e. the smaller the final section, the larger the amount of shift. A tool change requires time, whereas shifting movement of the tools by motor requires an elaborate mechanism "THE RUMX Radial Forging Machine" by M. G. Green and F. P. Ecken, SMS Sutton, Inc., SMS Masenclever Div., Pittsburgh, Pa.

The invention is based on a third type of long forging machine described in German Pat. No. DE-PS 21 59 461 on the understanding that, due to the possibility of guiding the tools in a curve alternatively to the radial movement, this type of machine can preforge the workpiece in a sort of "forging rolling process" which ensures optimum forging of the center of the workpiece at the heaviest reduction possible. Owing to the selective mode of moving the tools either linearly or in a curve relative to the centerline, this forging machine can produce sharp-edged workpieces with square or rectangular sections as well as round bars. To forge round bars, the rams carrying the tools are fixedly positioned relative to the straight guides by steering levers which cause the tools to perform a uniform and equidirectional swivel movement on a vertical plane, thereby effecting a "forging rolling movement". As a result of the swivel motion of the tools in the manner of an iris diaphragm, the forging machine requires only one set of tools for its entire working range (FIG. 1 and 2). To forge square or rectangular sections strictly by the radial method with fixedly positioned steering levers, the tools of this type of forging machine must also be changed or shifted transversely to the forging axis for small final sections.

BRIEF SUMMARY OF THE INVENTION

The object of the invention is to further advance a radial forging machine of the afore-described type in such a manner that the method of forging with linear radial movement of the tools will neither require tools to be changed for cross sectional adjustment nor shifting of the tools transversely to the forging axis in order to prevent synchronously driven tools from colliding in the process of forging small workpiece sizes.

This problem is solved by the invention in that each steering lever is provided with an additional tool to form two tool halves in conjunction with the tool at the ram-end, the tool halves being positioned parallel to the forging axis one beside the other on two different vertical planes, and in that the two pairs of rams and steering levers carrying the oppositely positioned tool halves are provided with an inverted succession of tool halves at the ram and steering lever ends as viewed toward the forging axis. Accordingly, by subdividing the tools into two tool halves which are positioned one beside the other and parallel to the forging axis, these tool halves may be selectively used as a whole for the forging rolling process or, by simply locking the tool halves at the steering lever end in place, the other tool halves may be used for the pure radial forging method, i.e. in pairs positioned on two slightly different vertical planes to virtually provide two free forging presses offset by 90 deg., the tools of which cannot collide. Although this universal forging method does not eliminate material spread, the advantage of the forging machine offered by the invention outweighs with respect to the fact that the metallurgically favorable preforging process over the round-section program may be combined with the universal process in a single operation and without time-consuming tool changes for the production of sharp-edged workpieces.

In order to ensure that the pairs of ram-end tool halves operating on two different vertical planes under the universal mode, exert equally heavy forces on the drive units independent of the forging mechanism, the rams and the tool halves carried by the rams on the one hand and the steering levers provided with the other tool halves on the other hand should preferably be separated from one another by means of the vertical plane extending in the direction of the force of the associated drive unit.

In contrast to the design disclosed in German Pat. No. DE-PS 21 59 461 which permits the steering levers to be selectively locked or unlocked with respect to the machine frame, the present invention further recommends means in the form of a bolt system which may be adjusted in aligned bores transversely to the direction of swivel movement and which will permit each steering lever to be selectively and positively locked to a ram or—in the outward stroke end-position of the rams—to the machine frame. This obviates the need for special pull-back cylinders and stop means on the frame. The rams must nevertheless be connected to the drive units, e.g. to hydraulic working cylinders, by link joints in a push and pull resisting manner.

Further design details of the bolt system proposed for quick motor-powered locking and unlocking action are described in the drawing.

The invention offers a further solution to the present object in that the tools are connected to their rams through a shifting device permitting each tool to be shifted by half its width away from the center position which is symmetrical to the direction of the force of the drive unit, in both directions of the forging axis. This again will provide two free forging presses operating on vertical side-by-side planes when the universal method is to be used without the need for tool change. For the forging rolling method, the tools remain in the center position symmetrical to the direction of force. Details of the shifting means are more closely described in the drawing.

When, under the two solutions offered, the rams are driven by hydraulic working cylinders, the invention provides means to disengage the synchronizing effect on one pair of oppositely positioned working cylinders, permitting adjustment of the rams one by one or in pairs by oppositely positioned working cylinders up to the point where the tools come into contact with the forging. In this manner, a deactivated pair of tools may be employed to guide the forging without complexity, while the other pair of tools may operate at a quick stroke speed. When oppositely positioned working cylinders are adjusted individually and opposedly, their tools may assume a guiding function for parts of the forging lying outside the forging axis.

The invention will now be described with reference to an exemplary embodiment thereof illustrated in the accompanying drawings wherein.

DETAILED DESCRIPTION

Figure 1:
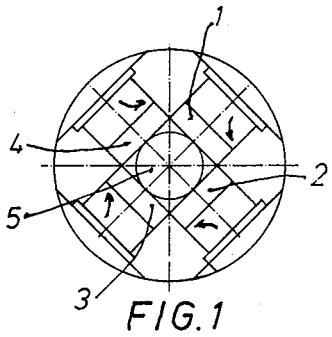
FIGS. 1 and 2 are schematic views which illustrate the forging rolling process.
Figure 2:
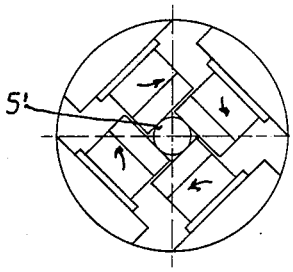

In FIG. 1 the four tools 1 to 4 of a radial forging machine are shown schematically, the tools being carried by steering levers, not shown, to perform swivel movements as indicated by the arrows. In consequence thereof, the round 5 to be forged down is caused to turn about its axis which prevents the formation of surface irregularities and ensures optimum forging treatment of the center of the workpiece. The round 5 may be forged down, for instance to the small section 5' in FIG. 2, with the same tools 1 to 4 since, due to the constant swivel movement, none of the four tools will be able to come into contact as the component increases in the tangential direction.

Figure 3:
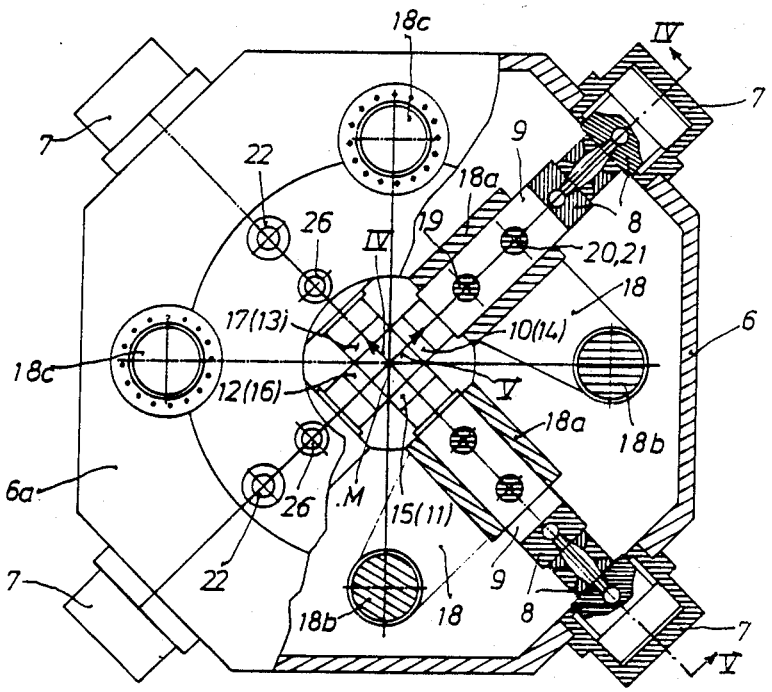
FIG. 3 is the front, partially cross-sectional view of a forging machine in accordance with the invention.

Having given account to the foregoing, the forging machine will now be described in detail according to the solution provided in FIG. 3 to 5. The forging machine has a frame 6, the front cover of which is cut open in FIG. 3 to show two drive units. The forging machine comprises four drive units radially arranged on a plane transverse to the forging axis M, each of the drive units consisting of a hydraulic working cylinder 7, a lock joint 8 and a ram 9. All rams 9 are guided in straight guides **18*a* by steering levers 18 supported in the covering frame sections 6*a* of the frame 6 through swivel shafts 18*b*. The plan view of the frame coverings 6*a* at the left in FIG. 3 shows two bearing hoods 18*c* for further swivel shafts 18*b***.

Figure 4:
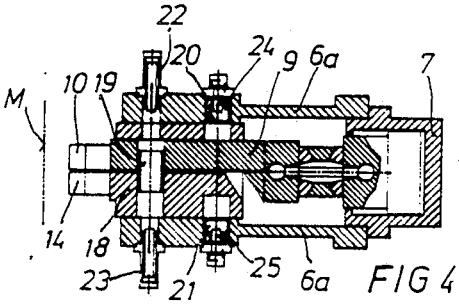
FIG. 4 is a cross-sectional view taken along line IV—IV in FIG. 3.
Figure 5:
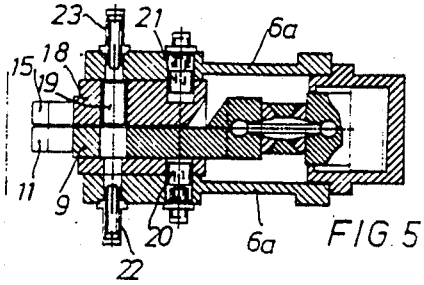
FIG. 5 is a cross-sectional view taken along line V—V in FIG. 3.

One of the two solutions provided by the invention is illustrated in FIG. 4 and 5. Whilst in the prior art the rams 9 carry tools 10 and 11 (and further tools 12, 13 in FIG. 3) the steering levers 18 and their straight guides **18*a* are each provided with an additional tool 14 and 15 (and 16 and 17 in FIG. 3). Together with a tool 10, 11, 12, 13 at the ram end, each additional tool 14, 15, 16, 17 forms two tool halves positioned one beside the other and parallel to the forging axis M on two different vertical planes, the tool halves jointly having the same width as, for instance, tools 1 to 4 in FIG. 1 and 2 of the prior art. In other words, these tools are subdivided into two halves such that side-by-side tools in FIG. 3 are positioned one behind the other. The numerals 14, 11, 16 and 13 marked off in brackets refer to tool halves which are concealed by the tool halves 10, 15, 12 and 17**.

This already indicates that the two pairs of rams 9 and steering levers 18 carrying the oppositely positioned tool halves are provided with an inverted succession of ram and steering lever tool halves 10 to 13 and 14 to 17 as viewed in the direction of the forging axis M. The significance of such inverted succession of tool halves will become apparent from the description of the operation of the forging machine.

As indicated in FIGS. 4 and 5, the rods 9 and the tool halves 10 and 11 carried by the rams on the one hand and the steering levers provided with the other tool halves 14 and 15 on the other hand are separated from one another by the vertical plane extending in the direction of the force of the associated drive unit 7. This produces the offset configuration of the rams 9 shown in FIGS. 4 and 5. As a result, the tool halves are always subjected to identical forces, independent of the forging direction.

The locking device will now be described with which each ram 9 may be selectively and positively locked either to the associated steering lever 18 or to the machine frame 6 and **6*a*. The covering frame sections 6*a*, the steering levers 18 and the rams 9 are provided with bores for accommodation of two cross bolt systems. One cross bolt system consists of a locking bolt 19 and two locking cylinders 22 and 23 provided with locking pistons in the covering frame sections 6*a* to permit the locking bolt 19 to be alternately shifted in transverse directions inside the rams 9 and steering levers 18. The second cross bolt system comprises two coaxial locking bolts 20, 21 each of which may be moved by the locking pistons 24, 25 of locking cylinders 26, 27 inside the covering frame sections 6*a* and steering levers 18 (please also refer to FIG. 8**).

Figure 6:
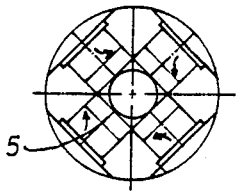
FIGS. 6 and 7 are views similar to FIGS. 1 or 2 which illustrate forging procedures.

Operation of the locking device and, thus, of the forging machine according to FIG. 3 is as follows:

In FIG. 4 the locking bolt 19 is shown in its internal locking position in which one ram 9 is positively locked to a steering lever 18 in the area of the straight guide **8*a*. On the other hand, the steering lever 18 is free to move, since the two locking bolts 20, 21 are in their withdrawn unlocking positions. The forging power produced by the working cylinders 7 is transmitted to both tool halves, e.g. to 10 and 14, which will cause them to function as a uniform tool. The steering levers 18 being freely movable, the tools will not perform a linear but rather a swiveling motion. The forging machine is thus set for the forging of a round 5 by the rolling forging method (FIG. 6**). This method may also be used for the preforging of bars which are to be forged down to final square or rectangular sharp-edged sections.

Figure 7:
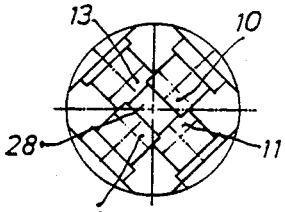

To set up the forging machine for the universal forging method, the locking cylinders 22 are actuated in the sense of piston rod extension which will move the locking bolts 19 into the stopping position shown in FIG. 5. At the same time, both locking cylinders 26, 27 are actuated to advance the locking bolts 20, 21 into locking position, also shown in FIG. 5. This will positively lock the steering levers 18 to the covering frame sections 6a and unlock the rams 9. The forging power produced by the working cylinders 7 will act solely on the straight-guided rams and on one tool half only, e.g. on tool half 11 in FIG. 5 and 10 in FIG. 4. Since—as mentioned before—these tool halves are located on two different vertical planes, pairs of oppositely positioned tool halves will operate comparatively in the form of two free forging presses offset by 90 deg., as schematically shown in FIG. 7. The ram-end tool halves 10 and 12 represent one free forging press, the second free forging press with tools 11 and 13 being positioned at a 90 deg. offset behind thereof. Since all working cylinders 7 are actuated synchronously, the forging rolling process employed for preforging the round 5 in FIG. 6 may be changed over to the universal mode without loss of time simply by actuating the locking device with the bolt systems 19, 20 and 21 for finish-forging of the bar to a sharp-edged section as shown in FIG. 7.

The forging machine may be provided with hydraulic control means to disengage the synchronizing action of a pair of oppositely positioned working cylinders 7 and to thereby permit adjustment of straight-guided rams 9 until the tools come into contact with the forging. As may be taken from FIG. 7, this will permit tools 10 and 12 to be merely used for guidance of the rectangular section 28 while forging is continued with the tools 11 and 13 only.

To reset the machine for the forging rolling process, locking cylinders 23, 24 and 25 are actuated to return locking bolts 19 to their locking positions and bolts 20 and 21 to their unlocking positions (FIG. 4). It stands to reason that such action requires the rams 9 to be in their external stroke end positions in order to bring all the bores in parts 6a, 18 and 9 into alignment. This ram position is also required when the forging machine is to be converted from one locking position in FIG. 4 into the other locking position in FIG. 5.

Figure 8:
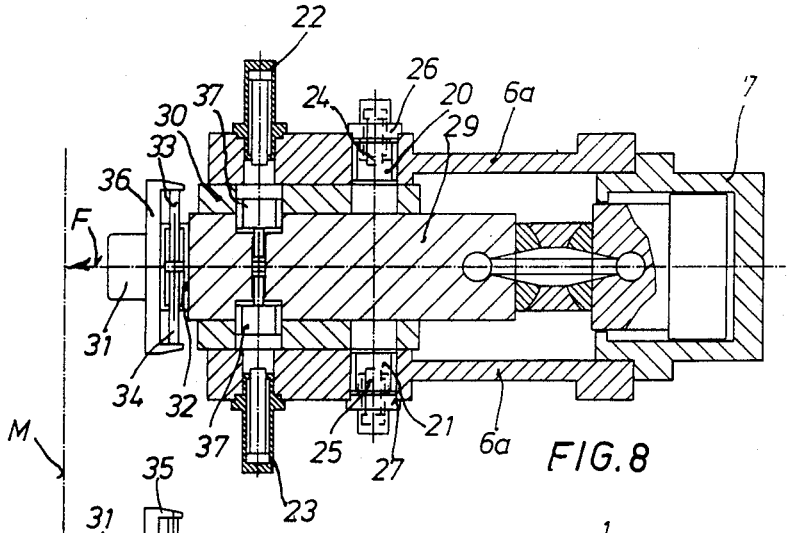
FIG. 8 is a view similar to FIGS. 4 and 5 showing a different embodiment of the invention.
Figure 9:
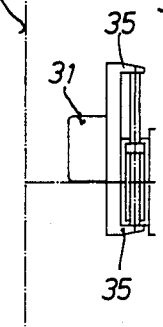
FIGS. 9 and 10 are elevational views of details of FIG. 8.
Figure 10:
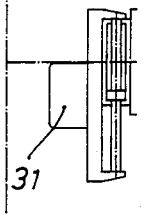

FIG. 8 to 10 suggest another solution to the problem of selectively setting up a forging machine either for the forging rolling process or the universal process without the need for tool change and without loss of time. In this case also, the forging machine has four drive units radially arranged on a plane transverse to the forging axis M, with hydraulic working cylinders 7, link joints 8, rams 29 and steering levers 30. All rams 29 carry singlepart tools 31 which are connected to their rams through a shifting device. Each shifting device consists of a locking cylinder 32 with alternately extending piston rods 33, 34, the cylinders 32 being attached to the rams 29 and the piston rod ends being connected to cross arms 35 (FIG. 9) of a plate 36 supporting the tool 31. The locking cylinders 32 affixed to the rams 29 transmit the forging power produced by the working cylinders 7 to the supporting plates 36 and tools 31. When the tools 31 in FIG. 8 are in their positions symmetrical to the direction of the force F of the working cylinders 7, the forging machine will be in its setting fit for the forging rolling process in which the rams 29 are locked to the free-moving steering levers 30 (FIG. 4) through the locking bolts 37. These locking bolts 37 may be internally actuated to unlock the rams 29. To lock the steering levers 30 to the covering frame sections 6a, the locking bolts 20, 21 are advanced in the same manner as shown in FIG. 5. In this locking position, the rams 29 perform linear movements for use of the universal method. In this case, pairs of oppositely positioned tools 31 are opposedly shifted by half the width of the tool and parallel to the forging axis M by means of the shifting device 32 to 36 (FIG. 9 and 10). Observing FIG. 7, the transverse shifting movement in FIG. 9 applies to the oppositely positioned tools 10 and 12 which form one of two free forging presses, while the opposedly shifted tools 31 in FIG. 10 correspond to the tools 11 and 13 positioned on a rear vertical plane to form a second free forging press.

I claim:

1. A forging machine for the forging of round or sharp-edged bars, having four drive units radially arranged on a machine frame on a plane transverse to the forging axis, synchronously driven rams supporting oppositely positioned tools facing each other in pairs, each ram being driven by a drive unit and each tool designed for forging a bar fed along said forging axis transverse to said plane, straight guides for guiding the rams by steering levers swivelley mounted on vertical surfaces and selectively lockable in place with respect to the machine frame so that said tools move along a straight path during forging, or swivelled in a vertical plane together with the rams when in locked position relative to the respective straight guide so that said tools move along an arcuate path during forging, wherein:

an additional tool is supported on each steering lever, each additional tool on each steering lever and each tool on the adjacent ram comprising a pair of tool halves positioned next to each other in a direction parallel to the forging axis and being movable on different vertical planes;

on each vertical surface two tool halves on opposite steering levers and two tool halves on opposite rams face each other; and a tool half on any steering lever is always adjacent a tool half on a ram.

2. Forging machine as claimed in claim 1 wherein:

said rams and said tool halves supported by said rams are separated from adjacent steering levers and respective tool halves supported thereon by a plane containing the central axis of force of a respective drive unit.

3. Forging machine as claimed in claim 1 wherein:

each steering lever is form-fitted and releasably locked to the respective ram by a first locking pin means adjustable in a direction transverse to the direction of movement of the ram; and each steering lever is releasably locked to the machine frame by second locking pin means adjustable in a direction substantially parallel to said first locking pin means.

4. Forging machine as claimed in claim 2 wherein:

each steering lever is form-fitted and releasably locked to the respective ram by a first locking pin means adjustable in a direction transverse to the direction of movement of the ram; and each steering lever is releasably locked to the machine frame by second locking pin means adjustable in a direction substantially parallel to said first locking pin means.

5. Forging machine as claimed in claim 1 wherein:

said drive units comprise hydraulic working cylinders;

one pair of facing tools operated by respective working cylinders is not synchronized; and the tools on said rams are selectively positionable against the workpiece individually and in pairs.

6. Forging machine as claimed in claim 3 wherein:

said first locking pin means comprises a bore in said ram, a first bore in said steering lever aligned with said bore in said ram in the withdrawn position, a ram locking pin slidable in said bores between a locking position where said ram locking pin extends in both bores and an unlocked position where said ram locking pin is fully within said bore in said steering lever; and means for moving said ram locking pin between said locked and unlocked positions; and said second locking pin means comprises at least one bore in said machine frame and at least one second bore in said steering lever aligned with said bore in said machine frame when said ram is in the withdrawn position, a frame locking pin slidable in said second bore and said bore in said machine frame between a locking position where said frame locking pin extends in both said second bore and said bore in said machine frame and a release position where said frame locking pin is fully within said bore in said machine frame, and means for moving said frame locking pin between said locked and release positions.

7. Forging machine as claimed in claim 4 wherein:

said first locking pin means comprises a bore in said ram, a first bore in said steering lever aligned with said bore in said ram in the withdrawn position, a ram locking pin slidable in said bores between a locking position where said ram locking pin extends in both bores and an unlocked position where said ram locking pin is fully within said bore in said steering lever, and means for moving said ram locking pin between said locked and unlocked positions; and said second locking pin means comprises at least one bore in said machine frame and at least one second bore in said steering lever aligned with said bore in said machine frame when said ram is in the withdrawn position, a frame locking pin slidable in said second bore and said bore in said machine frame between a locking position where said frame locking pin extends in both said second bore and said bore in said machine frame and a release position where said frame locking pin is fully within said bore in said machine frame, and means for moving said frame locking pin between said locked and release positions.

* * * * *